US012546335B1

(12) United States Patent
Chen et al.

(10) Patent No.: US 12,546,335 B1
(45) Date of Patent: Feb. 10, 2026

(54) DUAL-DUCT AIR PUMP

(71) Applicant: Guangdong Peir Outdoor Products Co., Ltd., Guangdong (CN)

(72) Inventors: Kaili Chen, Guangdong (CN); Xi Chen, Guangdong (CN)

(73) Assignee: Guangdong Peir Outdoor Products Co., Ltd., Huizhou (CN)

( * ) Notice: Subject to any disclaimer, the term of this patent is extended or adjusted under 35 U.S.C. 154(b) by 0 days.

(21) Appl. No.: 19/293,033

(22) Filed: Aug. 7, 2025

(30) Foreign Application Priority Data

Apr. 8, 2025 (CN) ..... 202520657767.5

(51) Int. Cl.

| | |
|---|---|
| ***F04D 29/42*** | (2006.01) |
| ***A47C 27/08*** | (2006.01) |
| ***F04B 23/14*** | (2006.01) |
| ***F04B 41/06*** | (2006.01) |
| ***F04B 45/047*** | (2006.01) |
| ***F04D 17/16*** | (2006.01) |
| ***F04D 25/16*** | (2006.01) |
| ***F04D 27/00*** | (2006.01) |
| ***F04D 29/44*** | (2006.01) |
| ***F04D 29/46*** | (2006.01) |

(52) U.S. Cl.
CPC ..... *F04D 29/4246* (2013.01); *A47C 27/082* (2013.01); *F04B 23/14* (2013.01); *F04B 41/06* (2013.01); *F04B 45/047* (2013.01); *F04D 17/16* (2013.01); *F04D 25/16* (2013.01); *F04D 25/166* (2013.01); *F04D 27/00* (2013.01); *F04D 27/005* (2013.01); *F04D 29/441* (2013.01); *F04D 29/462* (2013.01)

(58) Field of Classification Search
CPC ..... F04D 25/16; F04D 25/166; F04D 33/00; F04D 27/00; F04D 27/005; F04B 41/06; F04B 23/14; F04B 45/047; A47C 27/08; A47C 27/082
See application file for complete search history.

(56) References Cited

U.S. PATENT DOCUMENTS

| | | | | |
|---|---|---|---|---|
| 6,623,249 | B1 * | 9/2003 | Rogers | F04B 41/06 417/428 |
| 2020/0248706 | A1 * | 8/2020 | Liu | F04D 25/08 |
| 2021/0003120 | A1 * | 1/2021 | Huang | F04B 23/106 |

FOREIGN PATENT DOCUMENTS

| | | | | |
|---|---|---|---|---|
| EP | 3362688 | B1 * | 7/2024 | F04D 27/008 |

* cited by examiner

*Primary Examiner* — Christopher Verdier
(74) *Attorney, Agent, or Firm* — Birchwood IP

(57) ABSTRACT

Disclosed is a dual-duct air pump, including a pump casing, a centrifugal fan, and a diaphragm pump. A first air opening and a second air opening that are interconnected, and an independent air opening are disposed on the pump casing, the first air opening is used for communication with the outside world, and the second air opening and the independent air opening are used for communication with independent inflation cavities of an inflatable product; and the centrifugal fan is arranged inside the pump casing, and an air inlet end of the centrifugal fan is communicated with the first air opening. Using the centrifugal fan and the diaphragm pump inside a same fan, the two independent inflation cavities may be inflated based on different pressure requirements.

7 Claims, 13 Drawing Sheets

DUAL-DUCT AIR PUMP

TECHNICAL FIELD

The present disclosure relates to the technical field of air pumps, and in particular to a dual-duct air pump.

BACKGROUND

In outdoor recreational activities such as camping, outdoor tents serve as essential equipment. A typical outdoor tent includes a mattress and a plurality of support poles. In early outdoor tent designs, the mattress and the support poles employed an interconnected structure. Due to the interconnected structure between the mattress and the support poles, only a single air pump is needed to simultaneously inflate and deflate the mattress and the support poles. This design can simplify tent inflation procedures to some extent, reduce manufacturing costs, and enhance portability.

However, as consumers' demands for the performance and user experience of outdoor inflatable tents continue to rise, the traditional interconnected structure has gradually revealed significant limitations. Different usage scenarios and user needs result in notable differences in air pressure requirements for the mattress and the support poles. For instance, to ensure sleep comfort, the mattress requires relatively low and stable air pressure, while the support poles need higher air pressure to maintain sufficient structural strength and stability for tent support. The interconnected structure cannot satisfy the conflicting air pressure requirements of the mattress and the support poles, making it difficult for the tent to balance comfort and stability during use.

To solve the above differences in air pressure requirements, mutually independent structures for the mattress and support poles are employed in the related art, equipped with two independent air pumps for dedicated inflation of the mattress and support poles. Furthermore, for inflatable products like dual-chamber inflatable beds and sofas requiring distinct air pressures in independent inflation cavities, employing separate air pumps for each inflation cavity can address air pressure requirements of different inflation cavities and enhance the performance of inflatable products, but this approach introduces new challenges. On one hand, mounting two air pumps can significantly increase production costs, thereby driving up product prices and reducing market competitiveness. On the other hand, the addition of two air pumps can increase the bulk and weight of the equipment, severely compromising portability and usability for consumers, which contradicts the trend towards lightweight and user-friendly outdoor gear. Therefore, the present disclosure provides a dual-duct air pump to solve the above defects existing in the current inflatable products with two independent inflation cavities.

SUMMARY

To overcome the deficiencies of the related art, an objective of the present disclosure is to provide a dual-duct air pump capable of separately inflating and deflating two independent air inflation cavities to meet the pressure requirements of different air inflation cavities and enhance portability.

The objective of the present disclosure is realized by the following technical solutions:

a dual-duct air pump includes:

a pump casing, interconnected first air opening and second air opening, and an independent air opening being disposed on the pump casing, the first air opening being used for communication with the outside world, and the second air opening and the independent air opening being used for communication with independent inflation cavities of an inflatable product;

a centrifugal fan, the centrifugal fan being arranged inside the pump casing, an air inlet end of the centrifugal fan being communicated with the first air opening, and an air outlet end of the centrifugal fan being communicated with the second air opening; and a diaphragm pump, the diaphragm pump being arranged inside the pump casing, an air inlet end of the diaphragm pump being communicated with the first air opening, and an air outlet end of the diaphragm pump being communicated with the independent air opening.

Alternatively, a direction-change chamber, a third air opening, and a fourth air opening are further disposed inside the pump casing, the first air opening, the second air opening, the third air opening, and the fourth air opening are communicated with the direction-change chamber, the air inlet end of the centrifugal fan is communicated with the third air opening, the air outlet end of the centrifugal fan is communicated with the fourth air opening, and the air inlet end of the diaphragm pump is communicated with the third air opening; the dual-duct air pump further includes a direction-change block, a first air duct and a second air duct are disposed on the direction-change block, one end of the first air duct is communicated with the first air opening, one end of the second air duct is communicated with the second air opening, and the direction-change block is rotatably arranged inside the direction-change chamber; and when the direction-change block rotates under force, one of the other end of the first air duct and the other end of the second air duct is communicated with the third air opening, and the other is communicated with the fourth air opening.

Alternatively, the pump casing includes a bottom casing, a partition casing, and a top casing, a recessed cavity is disposed on the bottom casing, the independent air opening is located at a bottom of the bottom casing, the independent air opening is communicated with the recessed cavity, the top casing is seated at a top of the bottom casing, and the partition casing is arranged between the bottom casing and the top casing; and the direction-change chamber, the first air opening, the second air opening, the third air opening, and the fourth air opening are located on the partition casing, and the third air opening is communicated with the recessed cavity.

Alternatively, the centrifugal fan and the diaphragm pump are arranged on the partition casing, and the air inlet ends of the centrifugal fan and the diaphragm pump are communicated with the recessed cavity.

Alternatively, two switches are arranged on the partition casing, and two convex edges are arranged on the direction-change block. When the first air duct is communicated with the first air opening, one convex edge pushes against one switch, and the other convex edge keeps away from the other switch.

Alternatively, a lateral air opening is disposed on one side wall of the bottom casing, and the lateral air opening is communicated with the second air opening.

Alternatively, a first seal valve is arranged on the lateral air opening, and convex surfaces are arranged on the direction-change block. When the direction-change block rotates under force, the convex surfaces push against or keep away from the first seal valve.

Alternatively, a top-facing air opening is disposed on the top casing, and the top-facing air opening is communicated with the first air opening.

Compared with the related art, the present disclosure has the following beneficial effects.

In the present disclosure, the dual-duct air pump includes the pump casing, the centrifugal fan, and the diaphragm pump. The first air opening, the second air opening interconnected with the first air opening, and the independent air opening are disposed on the pump casing, the first air opening is used for communication with the outside world, and the second air opening and the independent air opening are used for communication with the independent inflation cavities of an inflatable product; the centrifugal fan is arranged inside the pump casing, the air inlet end of the centrifugal fan is communicated with the first air opening, and the air outlet end of the centrifugal fan is communicated with the second air opening; and the diaphragm pump is arranged inside the pump casing, the air inlet end of the diaphragm pump is communicated with the first air opening, and the air outlet end of the diaphragm pump is communicated with the independent air opening. In this way, using the centrifugal fan and the diaphragm pump inside a same fan, the two independent inflation cavities can be inflated based on different pressure requirements. Compared with the related art employing at least one air pump per inflation cavity, the number of air pumps can be reduced, thereby enhancing portability.

BRIEF DESCRIPTION OF THE DRAWINGS

To more clearly illustrate technical solutions in embodiments of the present disclosure, a brief description of the drawings required to be used in the embodiments is presented below. It is to be understood that the drawings described below are only some embodiments of the present disclosure and are not intended to limit the scope. For those ordinary skilled in the art, other related drawings may be obtained based on these drawings without creative efforts.

Figure 1:
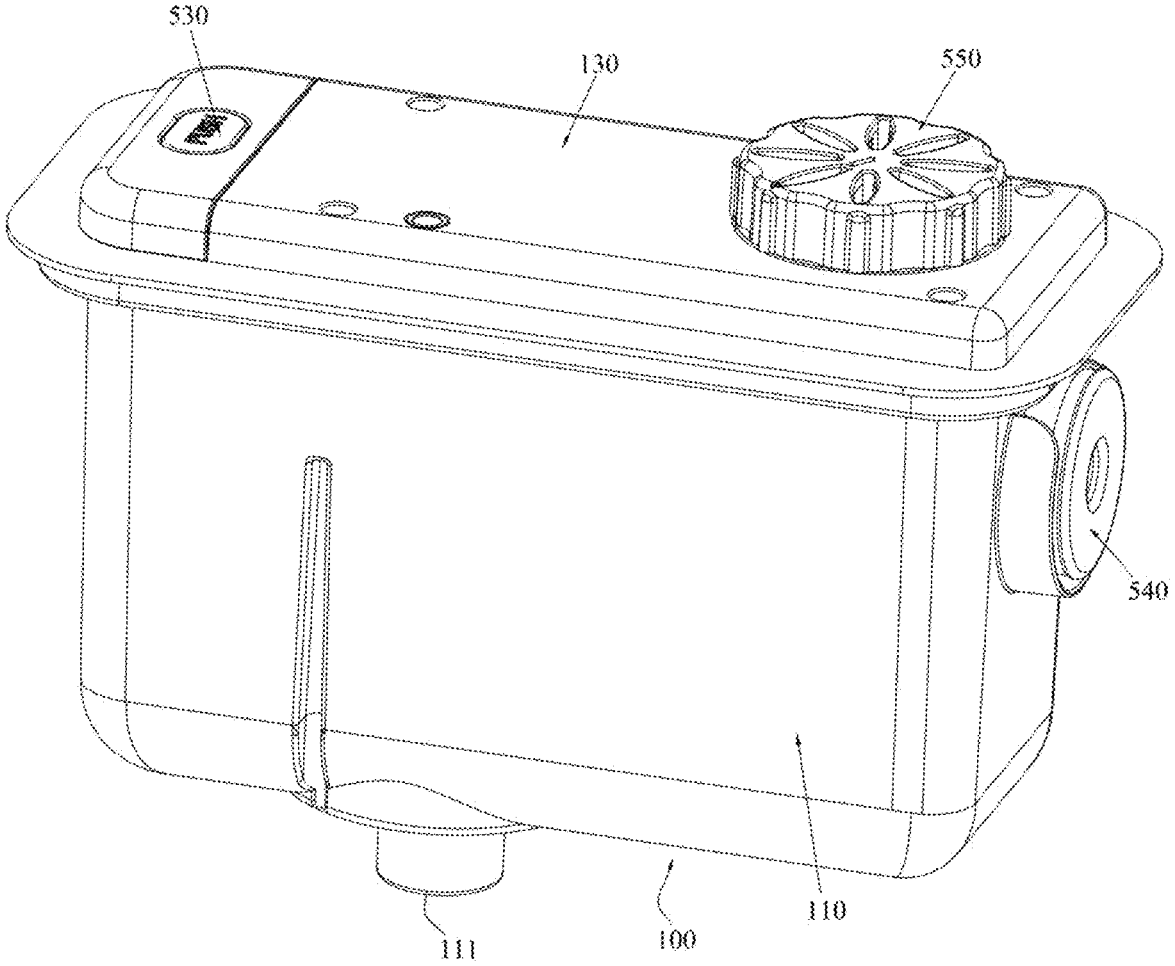
FIG. 1 is a schematic structural diagram of a dual-duct air pump according to one embodiment of the present disclosure.

Reference numerals and denotations thereof:

10—dual—duct air pump; 100—pump casing; 200—centrifugal fan; 300—diaphragm pump; 400—direction-change block; 111—independent air opening: 122—first air opening; 123—second air opening: 210—machine enclosure; 230—centrifugal motor; 211—centrifugal chamber; 212—air inlet; 213—air outlet; 310—diaphragm motor; 320—diaphragm casing; 330—floating disc; 321—air exchange groove; 322—air inlet hole; 323—air outlet hole; 324—air exchange inlet; 325—air exchange outlet; 340—counterflow block; 121—direction-change chamber; 124—third air opening; 125—fourth air opening; 410—first air duct; 420—second air duct; 110—bottom casing; 120—partition casing; 130—top casing; 112—recessed cavity; 510—switch; 430—convex edge; 520—battery; 530—push button; 113—lateral air opening; 540—first seal valve; 440—convex surface; 131—top-facing air opening; 550—rotary knob; and 560—second seal valve.

DETAILED DESCRIPTION

To facilitate the understanding of the present disclosure, the present disclosure is described more comprehensively below with reference to the accompanying drawings. Preferred embodiments of the present disclosure are shown in the drawings.

Referring to FIGS. 1-13, a dual-duct air pump includes a pump casing 100, a centrifugal fan 200, and a diaphragm pump 300. Interconnected first air opening 122 and second air opening 123, and an independent air opening 111 are disposed on the pump casing 100, the first air opening 122 is used for communication with the outside world, and the second air opening 123 and the independent air opening 111 are used for communication with independent inflation cavities of an inflatable product; the centrifugal fan 200 is arranged inside the pump casing 100, an air inlet end of the centrifugal fan 200 is communicated with the first air opening 122, and an air outlet end of the centrifugal fan 200 is communicated with the second air opening 123; and the diaphragm pump 300 is arranged inside the pump casing 100, an air inlet end of the diaphragm pump 300 is communicated with the first air opening 122, and an air outlet end of the diaphragm pump 300 is communicated with the independent air opening 111.

The centrifugal fan 200 and the diaphragm pump 300 are mounted inside the pump casing 100. The centrifugal fan 200 shares the first air opening 122 with the diaphragm pump 300. The centrifugal fan 200 discharges gas through the second air opening 123, while the diaphragm pump 300 discharges gas through the independent air opening 111. The second air opening 123 and the independent air opening 111 are communicated with the independent inflation cavities of the inflatable product. It is to be noted that the centrifugal fan 200 provides a relatively larger air volume but relatively lower air pressure. Therefore, it is suitable for inflation cavities requiring a large amount of inflation, such as mattresses for outdoor tents or other large spaces where low pressure is sufficient. The diaphragm pump 300 provides a relatively smaller air volume but relatively higher air pressure. Therefore, it is suitable for inflation cavities requiring high pressure, such as support poles of outdoor tents or other small spaces where higher pressure is essential. In this way, the centrifugal fan 200 and the diaphragm pump 300 can perform inflation in the independent inflation cavities based on different pressure requirements. Consequently, this configuration can allow for on-demand inflation of two independent inflation cavities within a single inflatable product, achievable with just a single air pump.

In a further description, in one embodiment, for the inflatable products featuring multiple independent inflation cavities with different pressure requirements, the quantity of centrifugal fans 200 and diaphragm pumps 300 can be configured as needed, such as three, four, or more, based on the actual requirements.

Figure 4:
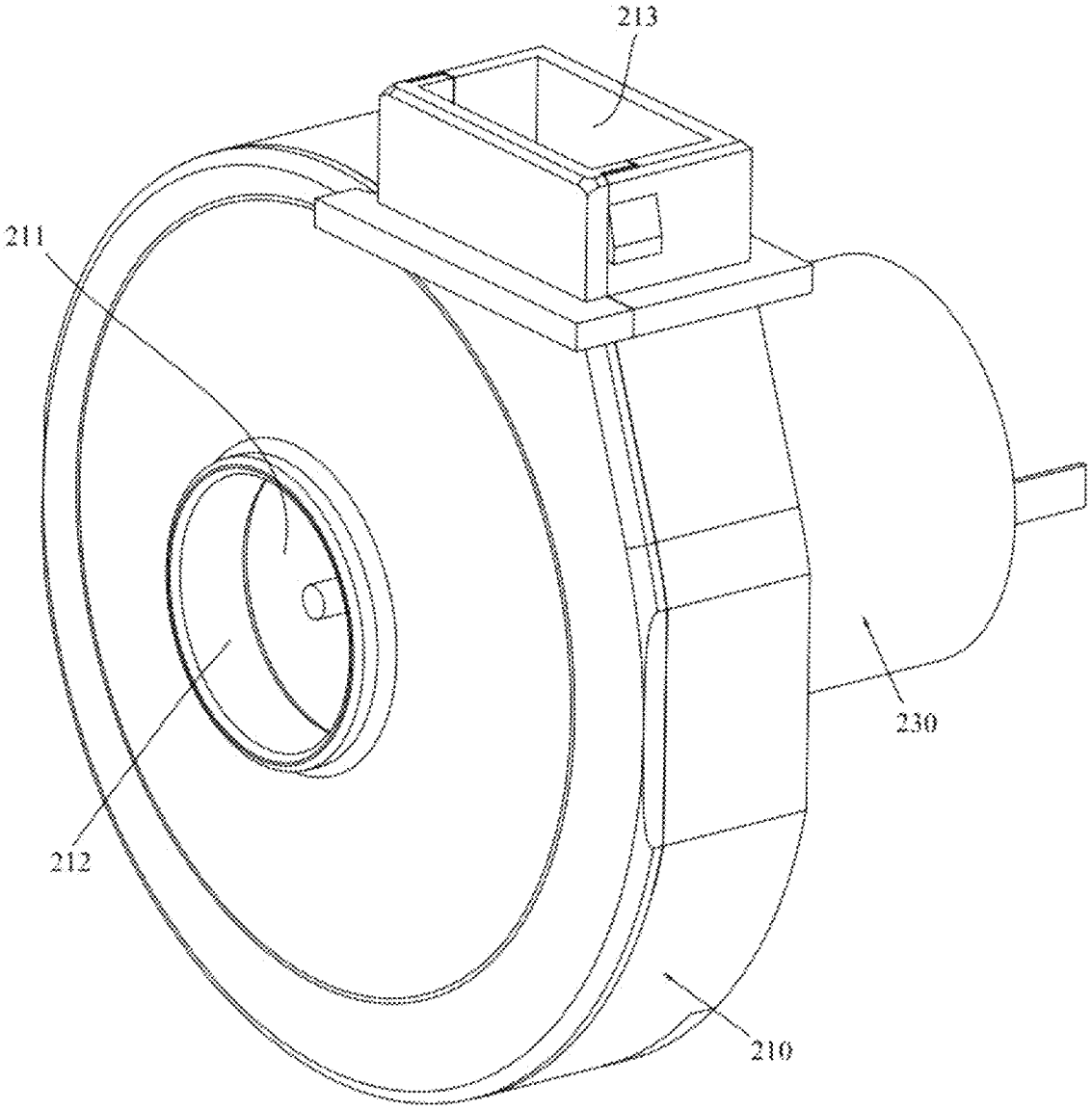
FIG. 4 is a schematic structural diagram of a centrifugal fan according to one embodiment of the present disclosure.

Referring to FIG. 4, in one implementation, the centrifugal fan 200 includes a machine enclosure 210, an impeller, and a centrifugal motor 230. A centrifugal chamber 211 is disposed inside the machine enclosure 210, an air inlet 212 and an air outlet are axially disposed on the centrifugal chamber 211, the centrifugal motor 230 is arranged on the machine enclosure 210, and the impeller is arranged on an output shaft of the centrifugal motor 230 and located inside the centrifugal chamber 211. Consequently, driven by the centrifugal motor 230, the impeller rotates, causing gas to enter the centrifugal chamber 211 through the air inlet 212 and be expelled from the air outlet 213.

Figure 5:
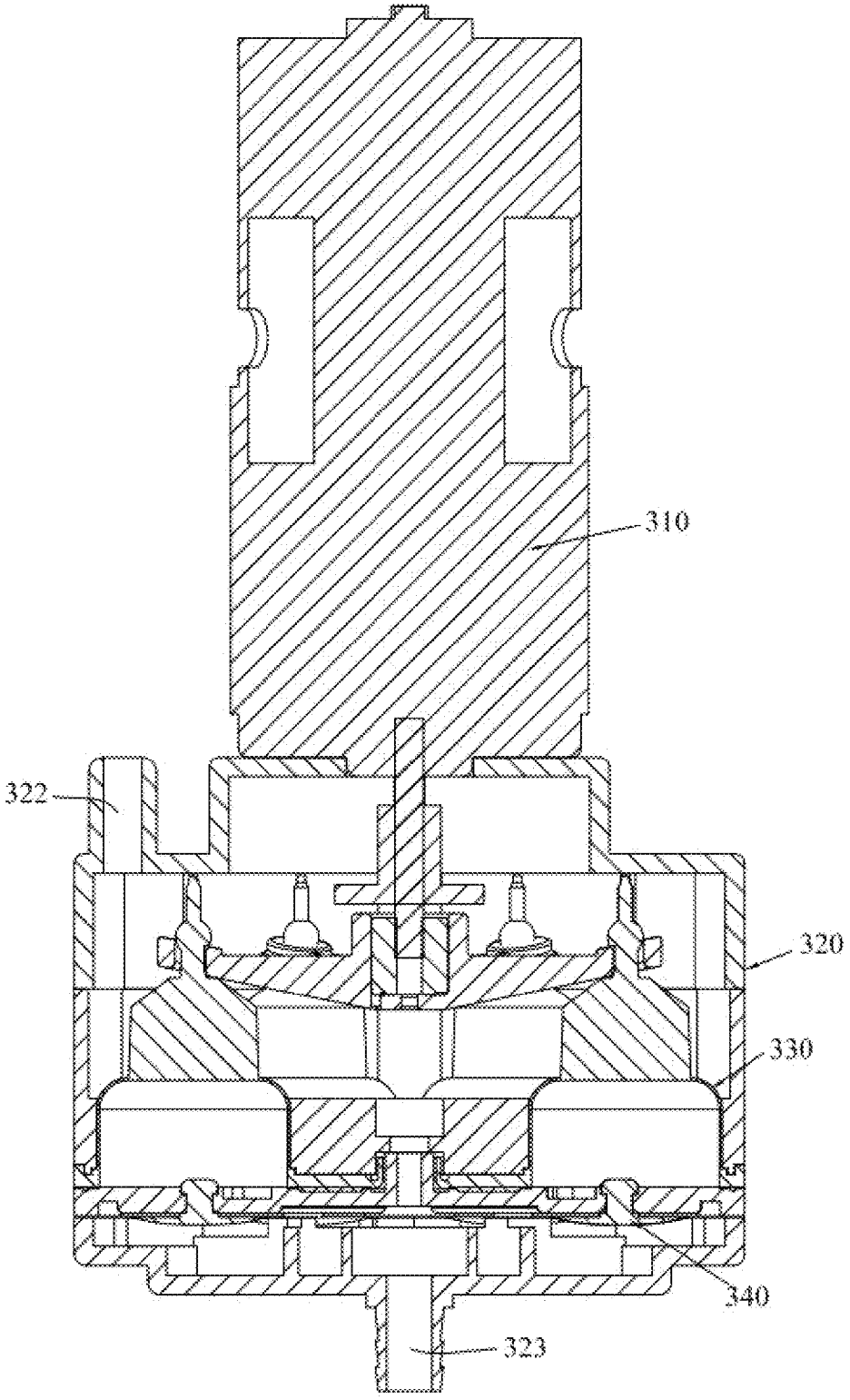
FIG. 5 is a cross-sectional schematic diagram of a diaphragm pump according to one embodiment of the present disclosure.
Figure 6:
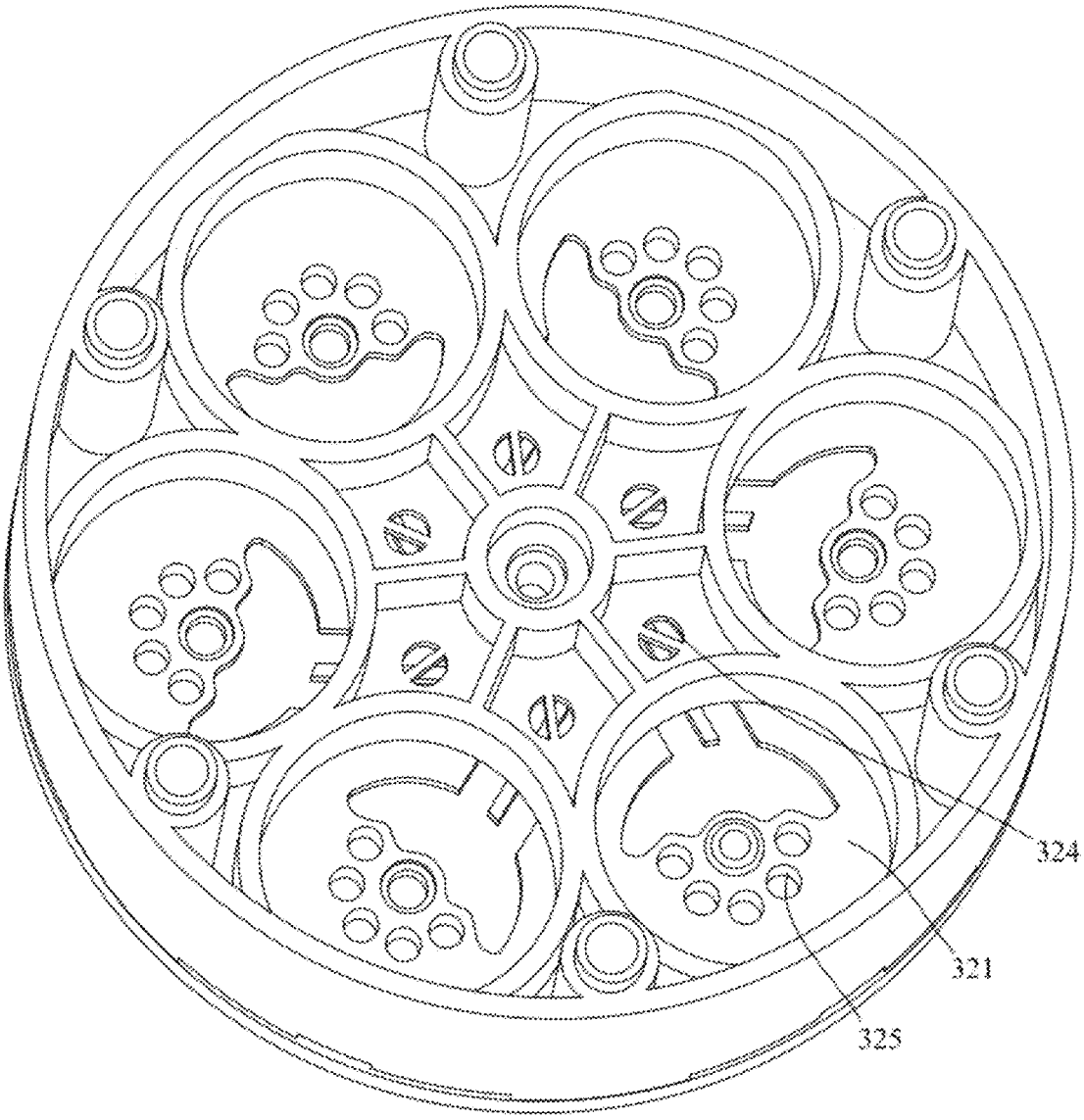
FIG. 6 is a partial schematic structural diagram of a diaphragm casing according to one embodiment of the present disclosure.

Referring to FIGS. 5-6, in one implementation, the diaphragm pump 300 includes a diaphragm motor 310, a diaphragm casing 320, and floating discs 330. Air exchange grooves 321 are disposed inside the diaphragm casing 320, the diaphragm motor 310 is arranged on the diaphragm casing 320, each floating disc 330 is connected to an output shaft of the diaphragm motor 310, and the floating discs 330 are seated against the air exchange grooves 321; and an air inlet hole 322, an air outlet hole 323, air exchange inlets 324, and air exchange outlets 325 are disposed on the diaphragm casing 320, the air inlet hole 322, the air outlet hole 323, the air exchange inlets 324, and the air exchange outlets 325 are communicated sequentially, and a counterflow block 340 is arranged on one side of the air exchange outlet 325 close to the air outlet hole 323.

The diaphragm motor 310 drives the floating discs 330 to reciprocate axially along the air exchange grooves 321 through a direction-change device. When the floating discs 330 move towards the air exchange grooves 321, the gas from the air exchange grooves 321 flows through the air exchange outlets 325 to open the counterflow blocks 340, and flows out via the air outlet hole 323. When the floating discs 330 rise away from the air exchange grooves 321, the air exchange outlets 325 are sealed off by the counterflow blocks 340. Consequently, the gas from the diaphragm casing 320 enters the air exchange grooves 321 through the air exchange inlets 324, while the gas from the diaphragm casing 320 flows into the air inlet hole 322. In this way, as the floating discs 330 undergo a reciprocating seating motion relative to the air exchange grooves 321, high-pressure airflow discharge is generated at the air outlet hole 323.

Referring to FIGS. 1-3 and 7-9, in one implementation, a direction-change chamber 121, a third air opening 124, and a fourth air opening 125 are further disposed inside the pump casing 100, the first air opening 122, the second air opening 123, the third air opening 124, and the fourth air opening 125 are communicated with the direction-change chamber 121, the air inlet end of the centrifugal fan 200 is communicated with the third air opening 124, the air outlet end of the centrifugal fan 200 is communicated with the fourth air opening 125, and the air inlet end of the diaphragm pump 300 is communicated with the third air opening 124, and the air outlet end of the diaphragm pump 300 is communicated with the independent air opening 111; the dual-duct air pump 10 further includes a direction-change block 400, a first air duct 410 and a second air duct 420 are disposed on the direction-change block 400, one end of the first air duct 410 is communicated with the first air opening 122, one end of the second air duct 420 is communicated with the second air opening 123, and the direction-change block 400 is rotatably arranged inside the direction-change chamber 121; and when the direction-change block 400 rotates under force, either the other end of the first air duct 410 or the other end of the second air duct 420 is communicated with the third air opening 124, and the remaining end is communicated with the fourth air opening 125.

The air inlet end of the centrifugal fan 200 is communicated with the third air opening 124, and the air outlet end of the centrifugal fan 200 is communicated with the fourth air opening 125. In this way, driven by the centrifugal fan 200, the gas flows from the direction-change chamber 121 through the third air opening 124, passes through the centrifugal fan 200, and enters the direction-change chamber 121 through the fourth air opening 125. Consequently, by rotating the direction-change block 400, the first air duct 410 and the second air duct 420 are changed to communicate with different air openings, thereby changing the exhaust or intake functions of the first air opening 122 and the second air opening 123. When the direction-change block 400 rotates under an external force, if the first air duct 410 is communicated with the first air opening 122 and the third air opening 124, the second air duct 420 is communicated with the second air opening 123 and the fourth air opening 125. When the centrifugal fan 200 is started, the gas flows sequentially in the order of the first air opening 122, the first air duct 410, the third air opening 124, the air inlet end of the centrifugal fan 200, the air outlet end of the centrifugal fan 200, the fourth air opening 125, the second air duct 420, and the second air opening 123. Due to the communication between the first air opening 122 and the outside world, and the communication between the second air opening 123 and one of the inflation cavities of the inflatable product, the centrifugal fan 200 can inflate the inflation cavity at this time.

If the first air duct 410 is communicated with the first air opening 122 and the fourth air opening 125, the second air duct 420 is communicated with the second air opening 123 and the third air opening 124. When the centrifugal fan 200 is started, the gas flows sequentially in the order of the second air opening 123, the second air duct 420, the third air opening 124, the air inlet end of the centrifugal fan 200, the air outlet end of the centrifugal fan 200, the fourth air opening 125, the first air duct 410, and the first air opening 122. Due to the communication between the first air opening 122 and the outside world, and the communication between the second air opening 123 and one of the inflation cavities of the inflatable product, the centrifugal fan 200 can extract air from the inflation cavity at this time.

In a further description, the diaphragm pump 300 is mounted inside the pump casing 100. The air inlet end of the diaphragm pump 300 is communicated with the third air opening 124, and the air outlet end of the diaphragm pump 300 is communicated with the independent air opening 111, while the independent air opening 111 is used for communicating with another independent inflation cavity of the inflatable product. In this way, both the diaphragm pump 300 and the centrifugal fan 200 are mounted inside the pump casing 100, but the two units operate independently, except that the two units can extract external air through the third air opening 124. Specifically, when the centrifugal fan 200 is actively inflating one inflation chamber of the inflatable product, the external air is drawn into the third air opening 124. At this time, the diaphragm pump 300 is started, pumping the gas from the independent air opening 111 into another inflation cavity of the inflatable product, thereby achieving the function of air intake through the shared first air opening 122. Furthermore, the difference between the diaphragm pump 300 and the centrifugal fan 200 lies in the fact that the centrifugal fan 200 is also used for extracting air from one inflation cavity of the inflatable product. When deflation is required for another inflation cavity of the inflatable product, manual pressure relief can be employed for air extraction instead of using the diaphragm pump 300, given a relatively smaller volume of this inflation cavity. In this way, this operation can allow the diaphragm pump 300 to function as a high-pressure inflation air pump. Consequently, using the same fan can allow it to perform both inflation and deflation for the two independent inflation cavities. Moreover, the air pressure between the independent inflation cavities is different.

Figure 3:
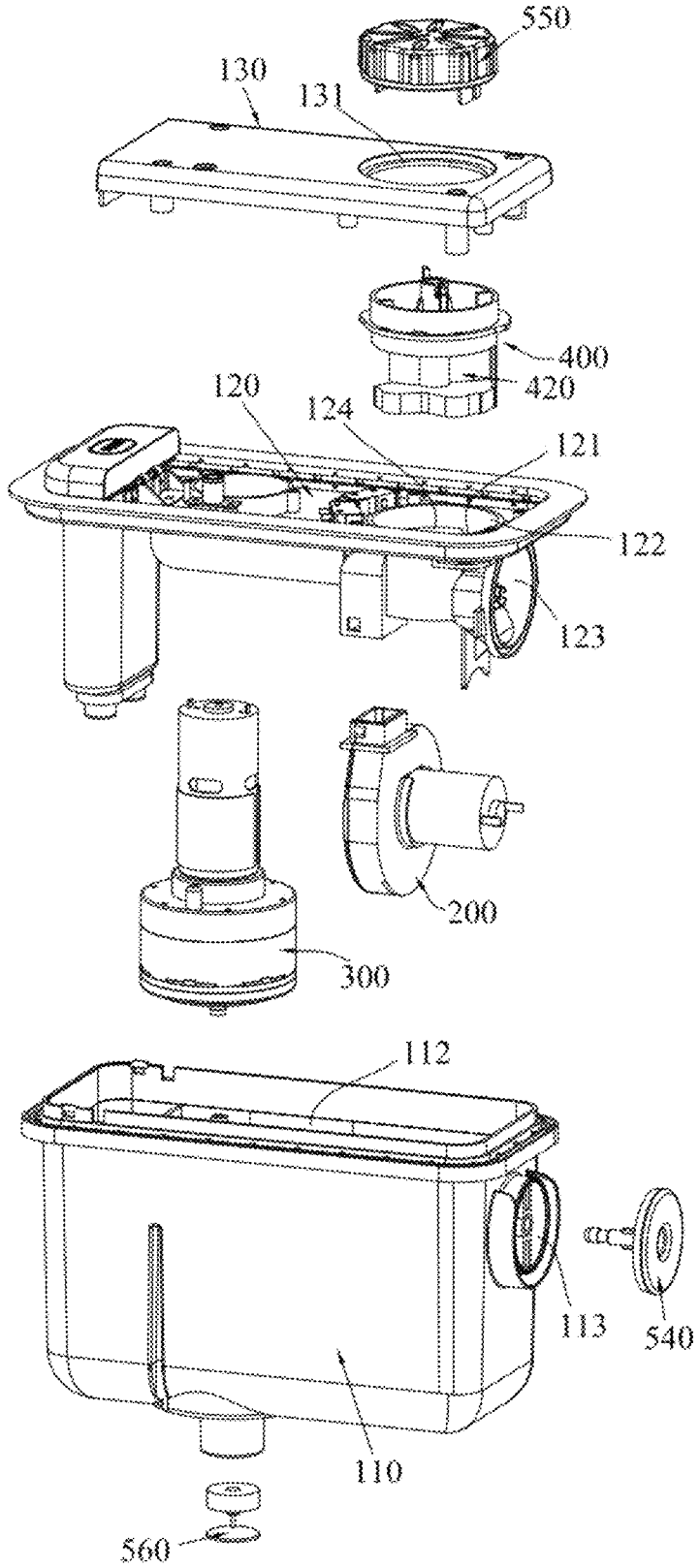
FIG. 3 is an exploded schematic structural diagram of the dual-duct air pump shown in FIG. 1.

Referring to FIG. 3, in one implementation, the pump casing 100 includes a bottom casing 110, a partition casing 120, and a top casing 130, a recessed cavity 112 is disposed on the bottom casing 110, the independent air opening 111 is located at a bottom of the bottom casing 110, the independent air opening 111 is communicated with the recessed cavity 112, the top casing 130 is seated at a top of the bottom casing 110, and the partition casing 120 is arranged between the bottom casing 110 and the top casing 130; and the direction-change chamber 121, the first air opening 122, the second air opening 123, the third air opening 124, and the fourth air opening 125 are located on the partition casing 120, and the third air opening 124 is communicated with the recessed cavity 112.

Due to the complicated internal structure of the pump casing 100, the pump casing 100 is arranged in a structure in which the bottom casing 110, the partition casing 120, and the top casing 130 are combined to facilitate production. The top casing 130 is seated and mounted on the bottom casing 110, and the partition casing 120 is arranged between the top casing 130 and the bottom casing 110. The direction-change chamber 121, the first air opening 122, the second air opening 123, the third air opening 124, and the fourth air opening 125 are located on the partition casing 120, and the third air opening 124 is communicated with the recessed cavity 112.

Figure 2:
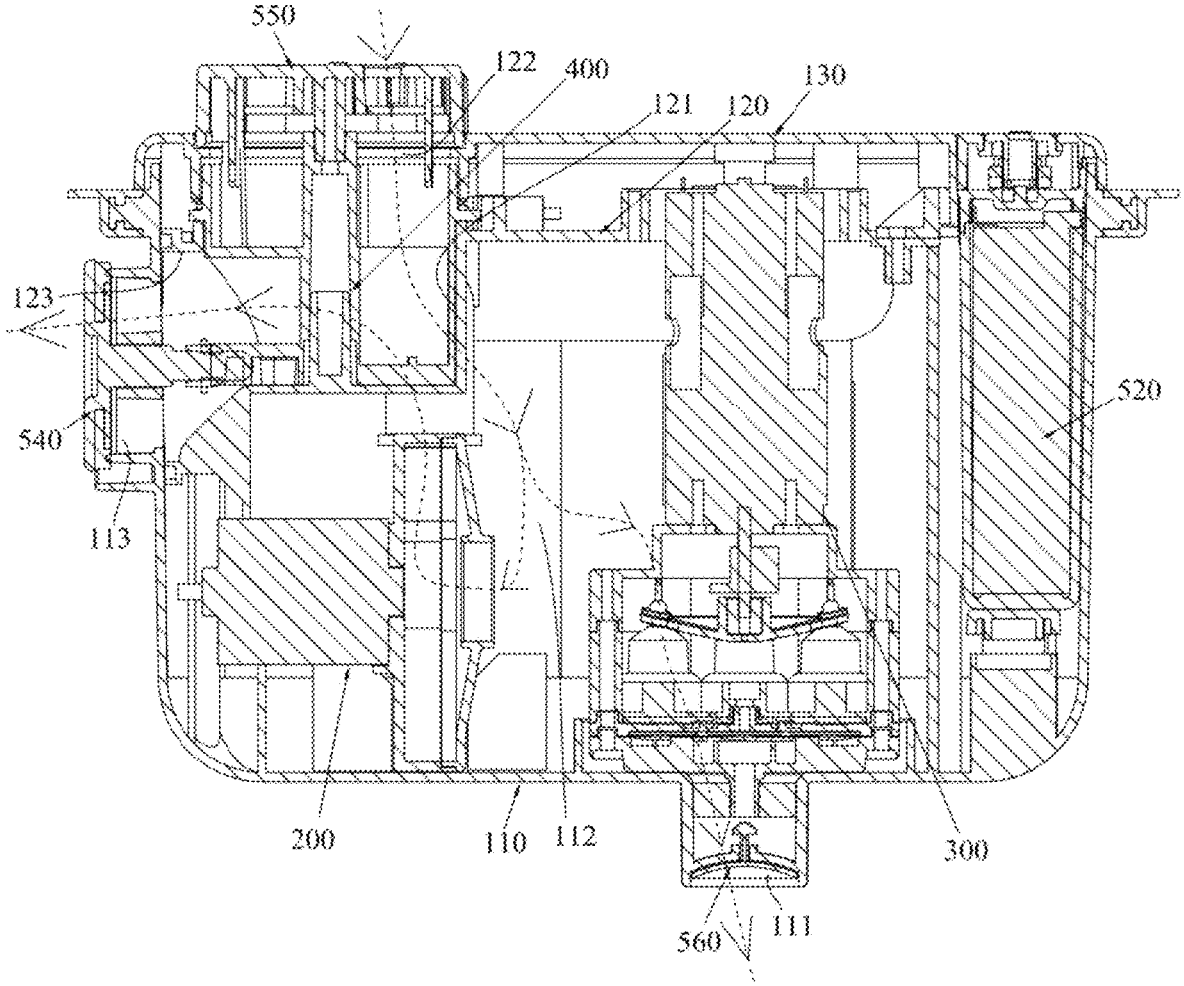
FIG. 2 is a cross-sectional schematic diagram of the dual-duct air pump shown in FIG. 1.

Referring to FIG. 2, in one implementation, the centrifugal fan 200 is arranged on the partition casing 120, and the air inlet end of the centrifugal fan 200 is communicated with the recessed cavity 112. Moreover, the diaphragm pump 300 is arranged on the partition casing 120, and the air inlet end of the diaphragm pump 300 is communicated with the recessed cavity 112.

The air inlet ends of the centrifugal fan 200 and the diaphragm pump 300 are communicated with the recessed cavity 112. In this way, after the gas enters the recessed cavity 112 from the third air opening 124, the gas passes through the centrifugal fan 200 and the diaphragm pump 300 to inflate the independent mattress and support poles of the outdoor tent.

Figure 7:
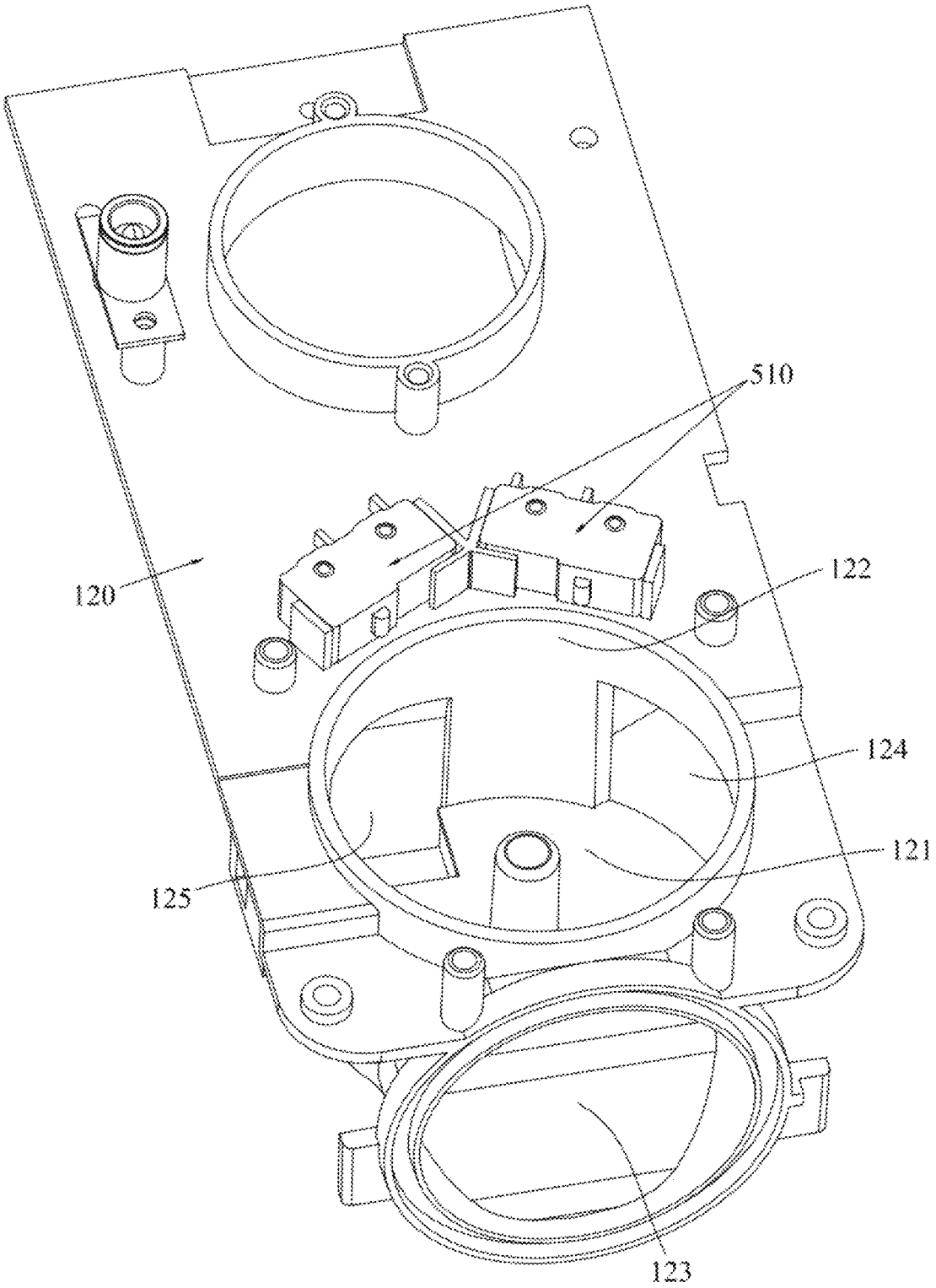
FIG. 7 is a schematic structural diagram of a partition casing according to one embodiment of the present disclosure.
Figure 8:
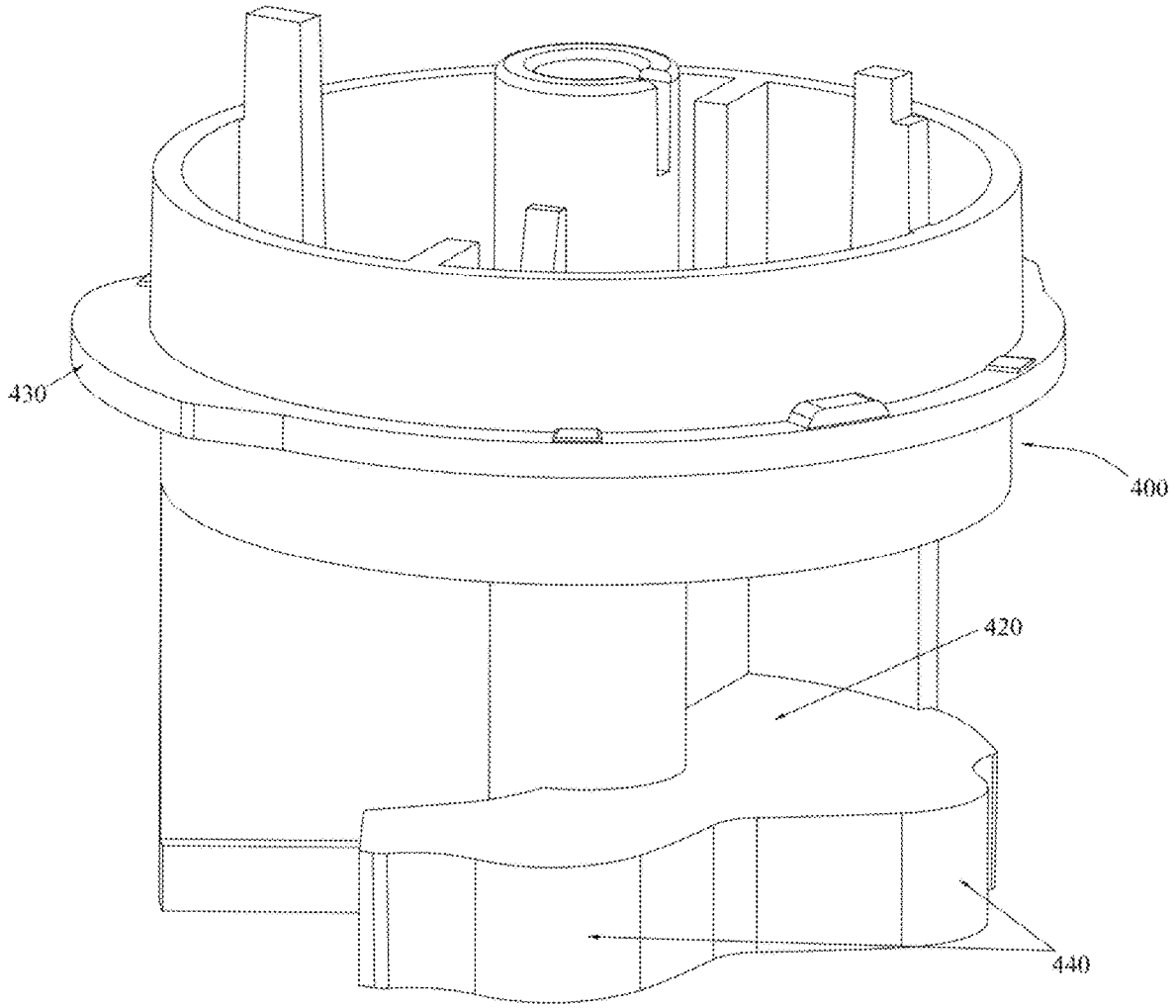
FIG. 8 is a schematic structural diagram of a direction-change block according to one embodiment of the present disclosure.
Figure 9:
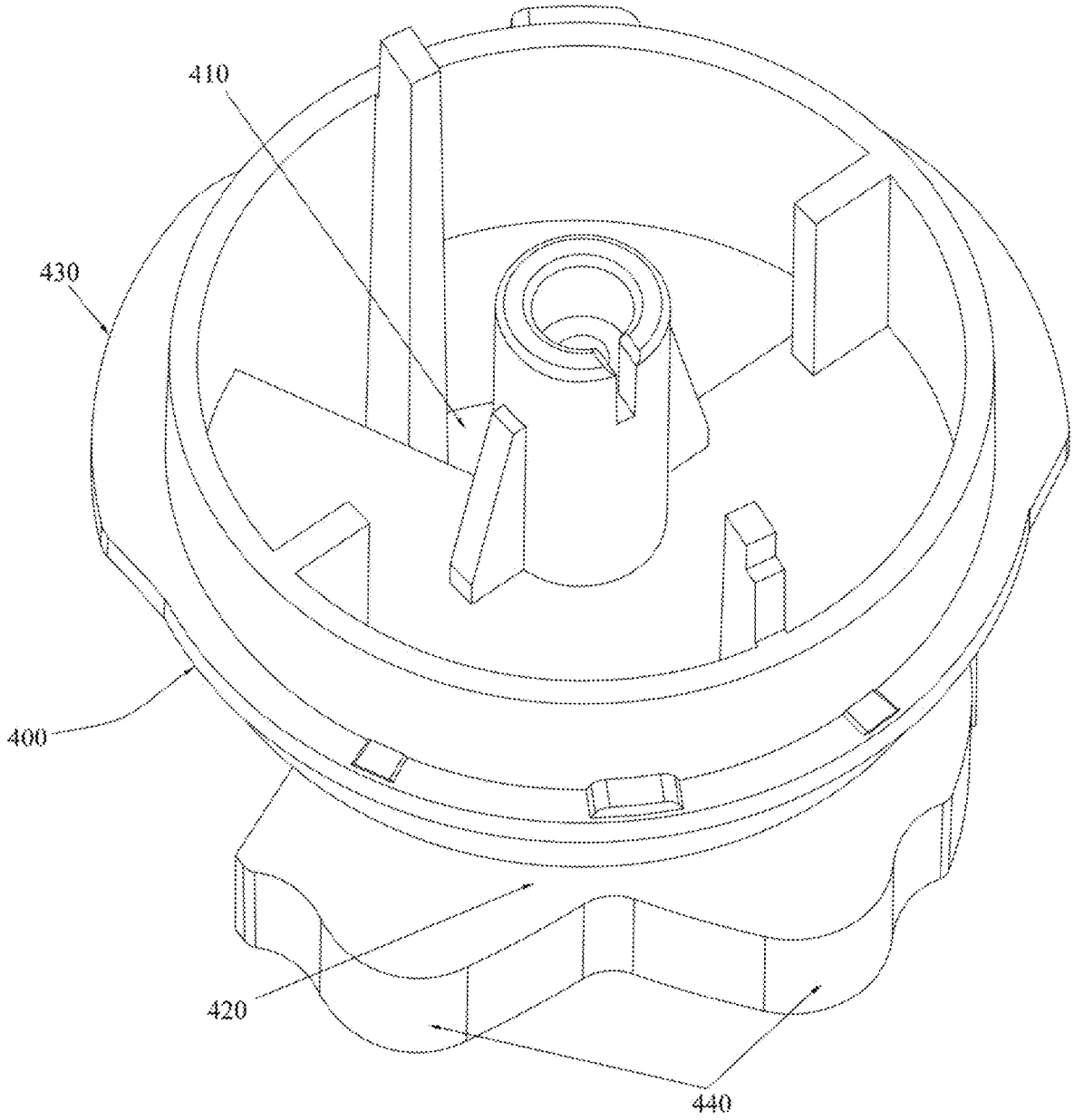
FIG. 9 is a schematic structural diagram from another perspective of the direction-change block shown in FIG. 8.
Figure 10:
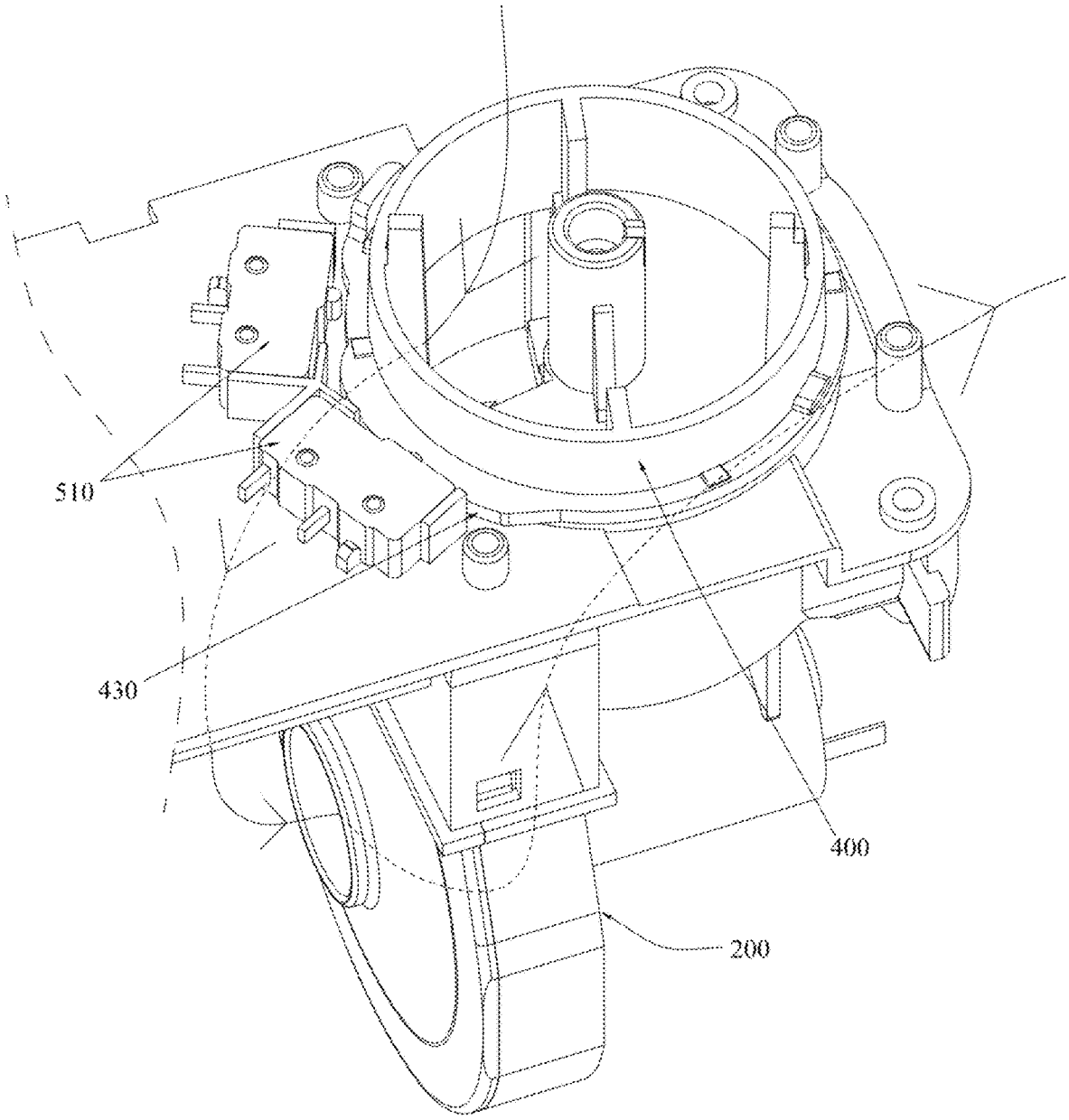
FIG. 10 is an airflow schematic diagram of an inflation process of a diaphragm pump according to one embodiment of the present disclosure.
Figure 11:
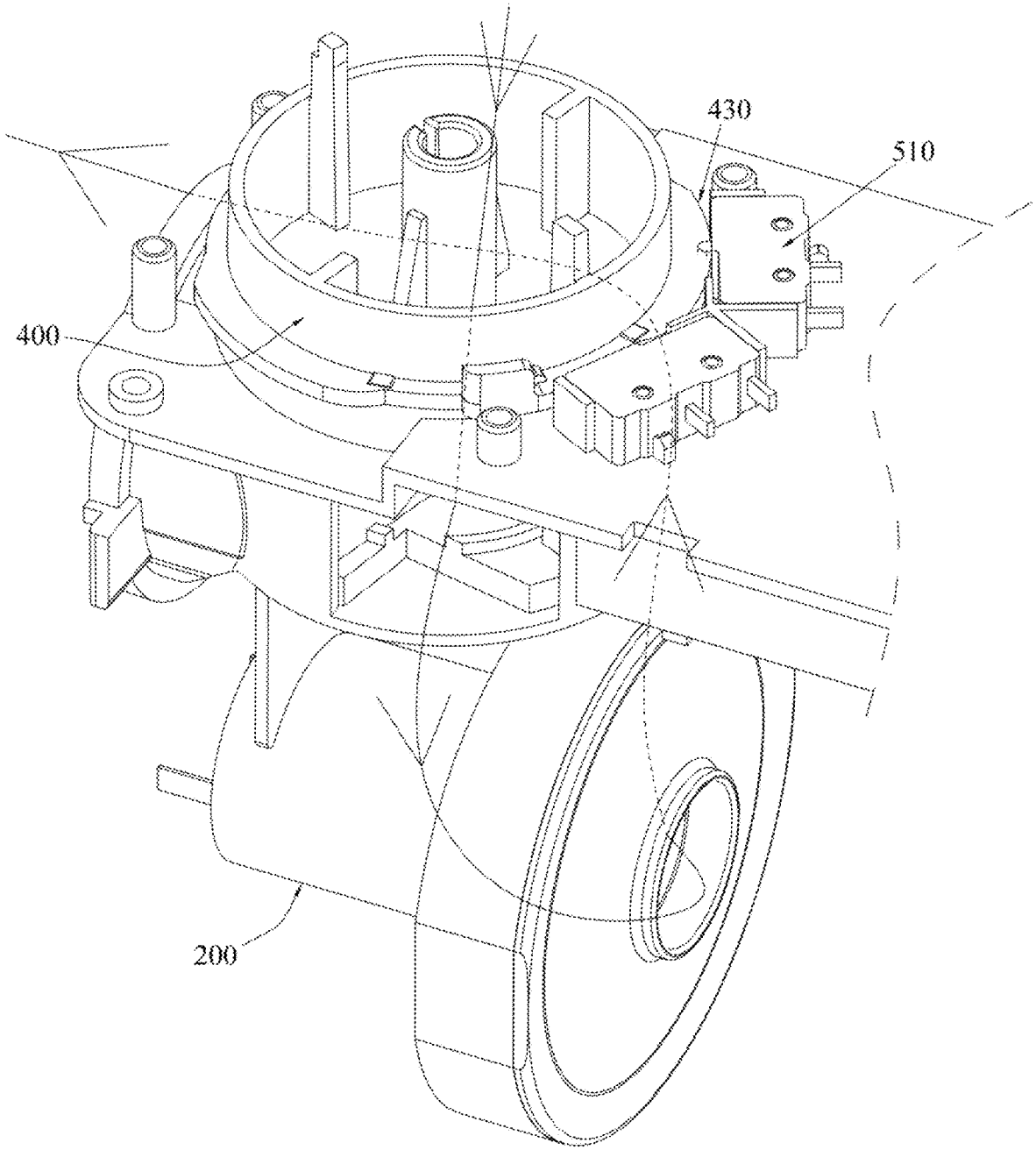
FIG. 11 is an airflow schematic diagram from another perspective of the inflation process of the diaphragm pump shown in FIG. 10.
Figure 12:
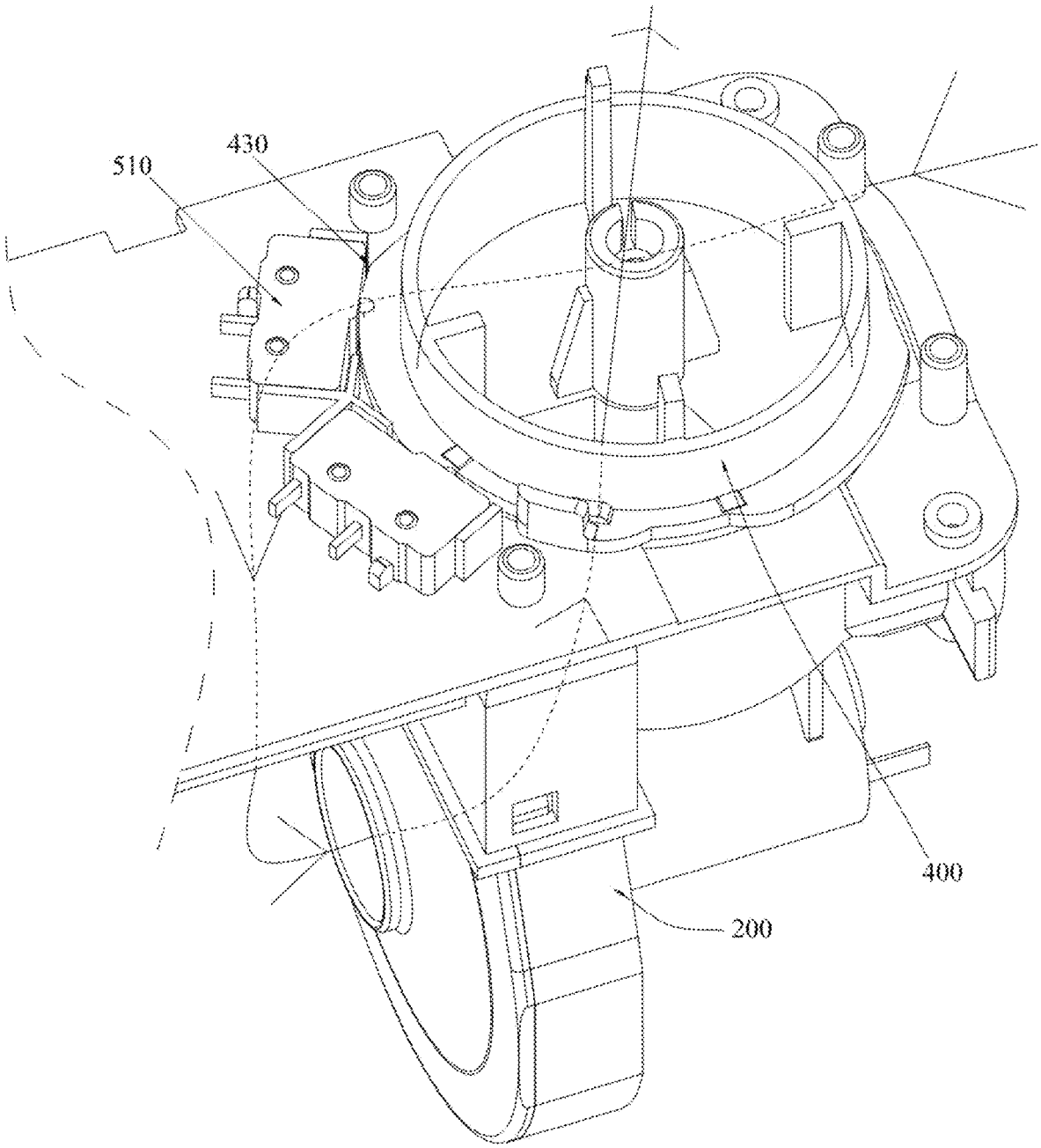
FIG. 12 is an airflow schematic diagram of a deflation process of a diaphragm pump according to one embodiment of the present disclosure.
Figure 13:
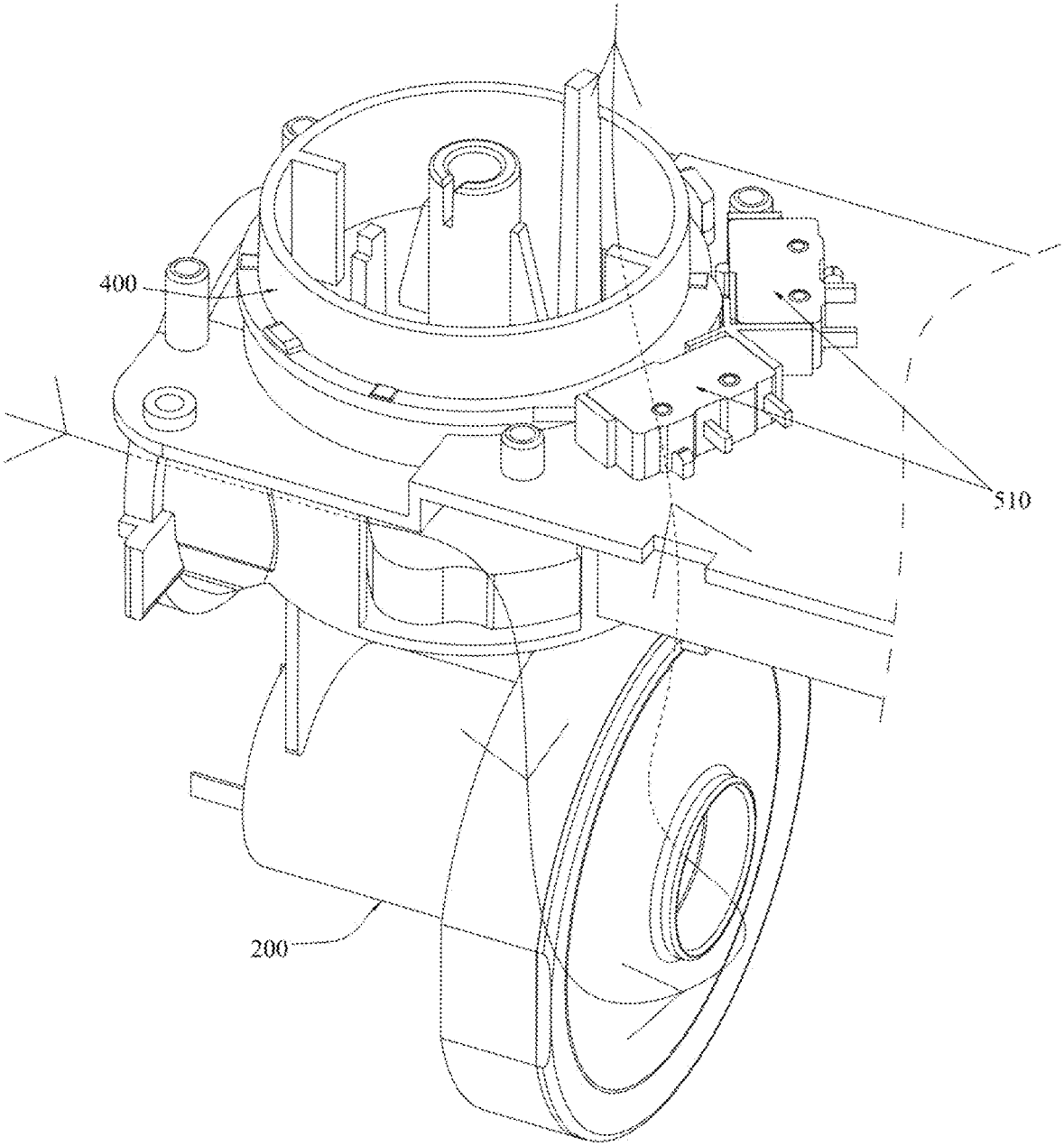
FIG. 13 is an airflow schematic diagram from another perspective of the deflation process of the diaphragm pump shown in FIG. 12.

Referring to FIGS. 7-9, in one implementation, two switches 510 are arranged on the partition casing 120, and two convex edges 430 are arranged on the direction-change block 400; and when the first air duct 410 is communicated with the first air opening 122, one convex edge 430 pushes against one switch 510, and the other convex edge 430 keeps away from the other switch 510.

The direction-change block 400 can rotate clockwise or counterclockwise. When the direction-change block 400 rotates in one direction, it is ensured that one convex edge 430 presses against one switch 510, and the other convex edge 430 keeps away from the other switch 510. In this way, to ensure that the direction-change block 400 rotates under force, one switch 510 can be pressed, thereby automatically starting the centrifugal fan 200 for inflation or deflation. In a further description, in one implementation, the start and stop of the centrifugal fan 200 and the diaphragm pump 300 can be realized by a manual button, an induction switch, or the like.

In a further description, referring to FIGS. 1-2, in one implementation, a circuit board is arranged on the partition casing 120, a battery 520 is arranged inside the bottom casing 110, the battery 520 is electrically connected to the circuit board, the circuit board is electrically connected to the switches 510, and the circuit board is electrically connected to the centrifugal fan 200 and the diaphragm pump 300. In a further description, in one implementation, a push button 530 is arranged on the top casing 130, the push button 530 is electrically connected to the circuit board, and the push button 530 is used for controlling the start and stop of the diaphragm pump 300.

Referring to FIG. 3, in one implementation, a lateral air opening 113 is disposed on one side wall of the bottom casing 110, and the lateral air opening 113 is communicated with the second air opening 123.

In this way, when the centrifugal fan 200 inflates the mattress, the gas flows into the mattress from the second air opening 123 through the lateral air opening 113. When the centrifugal fan 200 extracts air from the mattress, the gas flows from the mattress into the second air opening 123 through the lateral air opening 113.

In a further description, referring to FIGS. 2-3 and FIG. 8, in one implementation, a first seal valve 540 is arranged on the lateral air opening 113, and convex surfaces 440 are arranged on the direction-change block 400. When the direction-change block 400 rotates under force, the convex surfaces 440 push against or keep away from the first seal valve 540.

The first seal valve 540 is mounted on an inner side wall of the lateral air opening 113 via a spring. When the direction-change block 400 rotates under force, the convex surfaces 440 can push the first seal valve 540 to open the lateral air opening 113, thereby causing the airflow to smoothly flow through the lateral air opening 113. For instance, the first seal valve 540 is mounted on the lateral air opening 113 via the spring, and the first seal valve 540 is mounted on the same axis as the lateral air opening 113. The first seal valve 540 can slide along the axis of the lateral air opening 113 to close the lateral air opening 113 or open the lateral air opening 113. In a further description, in one implementation, two convex surfaces 440 are arranged. Therefore, when the direction-change block 400 rotates clockwise or counterclockwise to inflate or exhaust the outdoor tent, it is ensured that one convex surface 440 steadily pushes the first seal valve 540 to open the lateral air opening 113.

Referring to FIG. 3, in one implementation, a top-facing air opening 131 is disposed on the top casing 130, and the top-facing air opening 131 is communicated with the first air opening 122. In this way, the top casing 130 can avoid the direction-change block 400 to ensure that the gas can communicate with the outside world from the first air opening 122 via the top-facing air opening 131.

Referring to FIG. 1, in one implementation, a rotary knob 550 is arranged on the direction-change block 400, and the rotary knob 550 passes through the top-facing air opening 131, extending to an outer side of the top casing 130.

It is to be noted that the rotary knob 550 extends to the outer side of the top casing 130. In this way, the direction-change block 400 can be driven to rotate by applying torque to the rotary knob 550. A through hole communicated with the first air duct 410 of the direction-change block 400 is disposed on the rotary knob 550, thereby ensuring that the first air duct 410 is communicated with the outside through the through hole.

Referring to FIGS. 2-3, in one implementation, a second seal valve 560 is arranged on an inner side wall of the independent air opening 111.

The second seal valve 560 is a silicone valve plate, and the second seal valve 560 is fixed to the inner wall of the independent air opening 111 via a spring. The independent air opening 111 is sealed using the second seal valve 560, preventing air within the support poles of the outdoor tent from escaping through the independent air opening 111.

The above embodiments only express several implementations of the present disclosure, and the description thereof is more specific and detailed, but it cannot be understood as a limitation on the scope of the present disclosure accordingly. Unless otherwise specifically defined, the terms "mounted", "fixed", and "arranged" mentioned in the present disclosure can be understood as including but not limited to using bolts/screws for locking and fixing, and welding. It is to be noted that a person of ordinary skilled in the art may make several modifications and improvements without departing from the principle of the present disclosure, and these modifications and improvements all fall within the scope of protection of the present disclosure. Therefore, the scope of protection of the present disclosure is subject to the attached claims.

The invention claimed is:

1. A dual-duct air pump, comprising:

a pump casing, a first air opening and a second air opening that are interconnected, and an independent air opening being disposed on the pump casing, the first air opening being used for communication with the outside world, and the second air opening and the independent air opening being used for communication with independent inflation cavities of an inflatable product;

a centrifugal fan, the centrifugal fan being arranged inside the pump casing, an air inlet end of the centrifugal fan being communicated with the first air opening, and an air outlet end of the centrifugal fan being communicated with the second air opening; and a diaphragm pump, the diaphragm pump being arranged inside the pump casing, an air inlet end of the diaphragm pump being communicated with the first air opening, and an air outlet end of the diaphragm pump being communicated with the independent air opening;

wherein a direction-change chamber, a third air opening, and a fourth air opening are disposed inside the pump casing; the first air opening, the second air opening, the third air opening, and the fourth air opening are communicated with the direction-change chamber;

the air inlet end of the centrifugal fan is communicated with the third air opening, the air outlet end of the centrifugal fan is communicated with the fourth air opening, and the air inlet end of the diaphragm pump is communicated with the third air opening;

the dual-duct air pump further comprises a direction-change block;

a first air duct and a second air duct are disposed on the direction-change block, one end of the first air duct is communicated with the first air opening, one end of the second air duct is communicated with the second air opening, and the direction-change block is rotatably arranged inside the direction-change chamber; and when the direction-change block rotates under force, either the other end of the first air duct or the other end of the second air duct is communicated with the third air opening, and a remaining end is communicated with the fourth air opening.

2. The dual-duct air pump according to claim 1, wherein the pump casing comprises a bottom casing, a partition casing, and a top casing, a recessed cavity is disposed on the bottom casing, the independent air opening is located at a bottom of the bottom casing, the independent air opening is communicated with the recessed cavity, the top casing is seated at a top of the bottom casing, and the partition casing is arranged between the bottom casing and the top casing; and the direction-change chamber, the first air opening, the second air opening, the third air opening, and the fourth air opening are located on the partition casing, and the third air opening is communicated with the recessed cavity.

3. The dual-duct air pump according to claim 2, wherein the centrifugal fan and the diaphragm pump are arranged on the partition casing, and the air inlet ends of the centrifugal fan and the diaphragm pump are communicated with the recessed cavity.

4. The dual-duct air pump according to claim 2, wherein two switches are arranged on the partition casing, and two convex edges are arranged on the direction-change block; and when the first air duct is communicated with the first air opening, one convex edge pushes against one switch, and the other convex edge keeps away from the other switch.

5. The dual-duct air pump according to claim 2, wherein a lateral air opening is disposed on one side wall of the bottom casing, and the lateral air opening is communicated with the second air opening.

6. The dual-duct air pump according to claim 5, wherein a first seal valve is arranged on the lateral air opening, and convex surfaces are arranged on the direction-change block; and when the direction-change block rotates under force, the convex surfaces push against or keep away from the first seal valve.

7. The dual-duct air pump according to claim 2, wherein a top-facing air opening is disposed on the top casing, and the top-facing air opening is communicated with the first air opening.

* * * * *